US007124802B2

(12) United States Patent
Sudano

(10) Patent No.: US 7,124,802 B2
(45) Date of Patent: Oct. 24, 2006

(54) CASCADE SHADE

(75) Inventor: Angelo Sudano, Boisbriand (CA)

(73) Assignee: Royal Group Technologies Limited, Woodbridge (CA)

( * ) Notice: Subject to any disclaimer, the term of this patent is extended or adjusted under 35 U.S.C. 154(b) by 259 days.

(21) Appl. No.: 10/849,143

(22) Filed: May 20, 2004

(65) Prior Publication Data

US 2004/0231805 A1 Nov. 25, 2004

(30) Foreign Application Priority Data

May 21, 2003 (CA) ..... 2430180

(51) Int. Cl.
*E06B 9/08* (2006.01)
*E06B 9/305* (2006.01)

(52) U.S. Cl. ..... 160/89; 160/113; 160/176.1 R

(58) Field of Classification Search ..... 160/89, 160/176.1 R, 168.1 R, 113
See application file for complete search history.

(56) References Cited

U.S. PATENT DOCUMENTS

| | | | | |
|---|---|---|---|---|
| 5,690,156 | A * | 11/1997 | Ruggles | 160/84.04 |
| 6,068,039 | A * | 5/2000 | Judkins | 160/84.05 |
| 6,196,291 | B1 * | 3/2001 | Rupel et al. | 160/84.05 |
| D493,650 | S * | 8/2004 | Tuzmen | D6/575 |

* cited by examiner

*Primary Examiner*—Hugh B. Thompson, II
*Assistant Examiner*—Candace L. Bradford

(57) ABSTRACT

A cascade shade comprising a horizontal blind and a fabric cover assembly having means to attach it to the blind to produce a series of cascading loops or folds covering the blind without interfering with the raising, lowering, opening or closing of the blind.

17 Claims, 8 Drawing Sheets

FIG. 1.
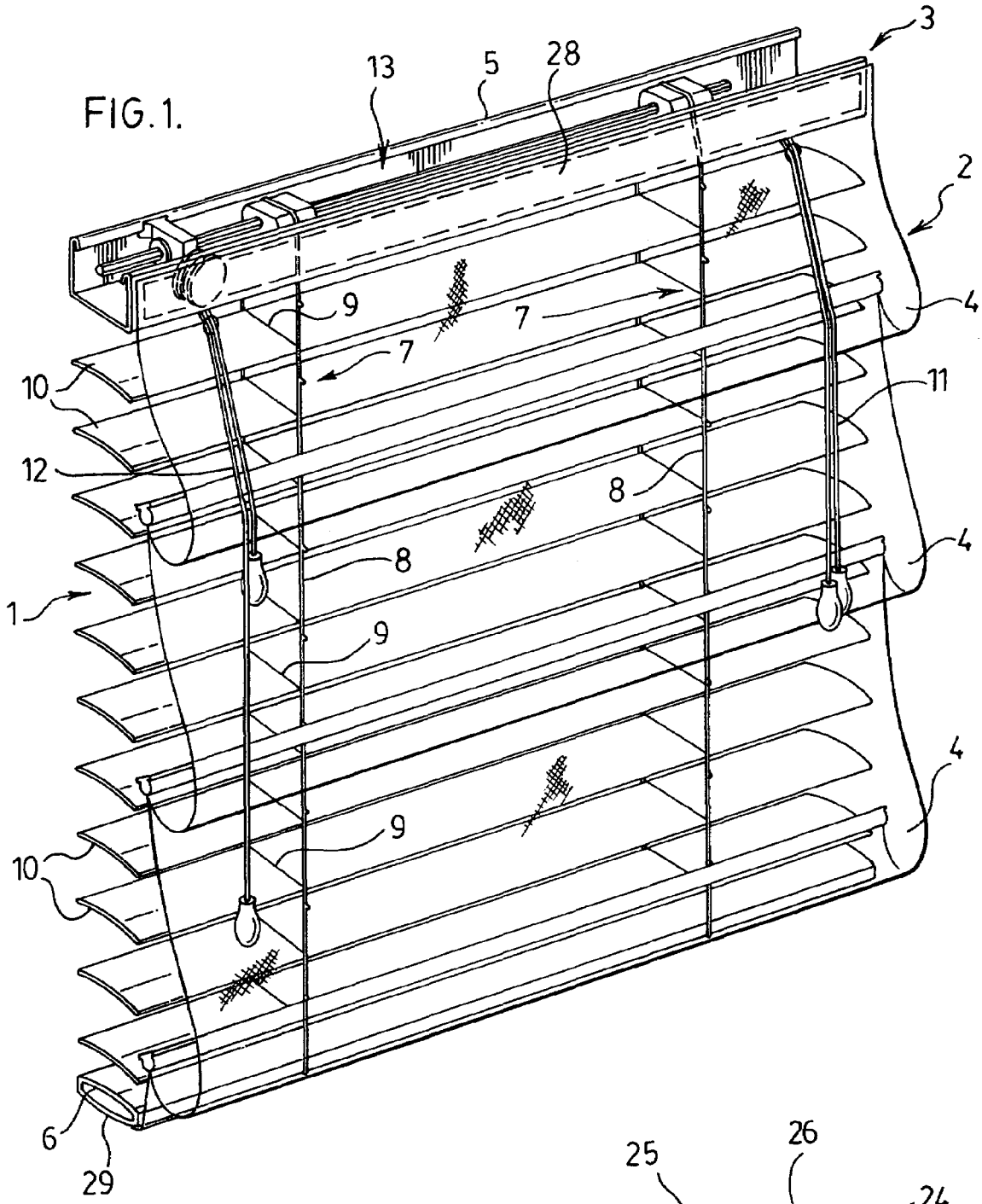
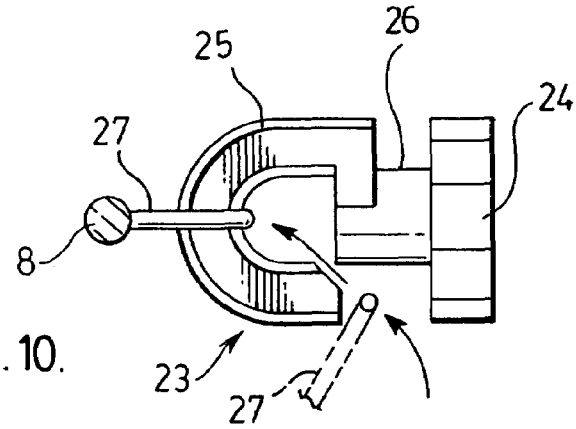
FIG. 10.

FIG. 5.
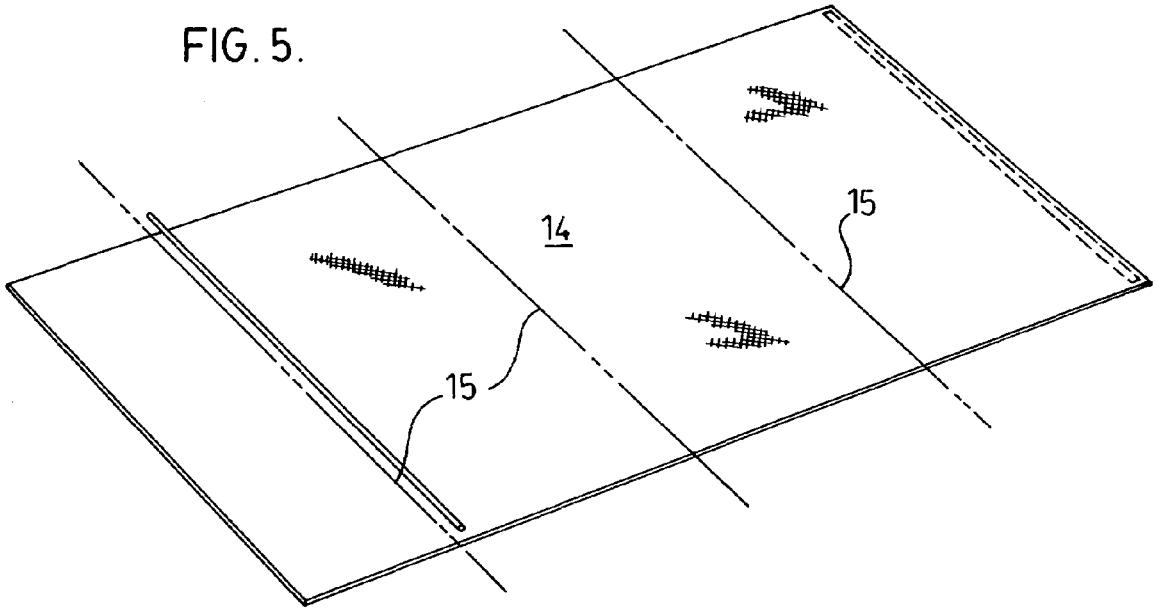
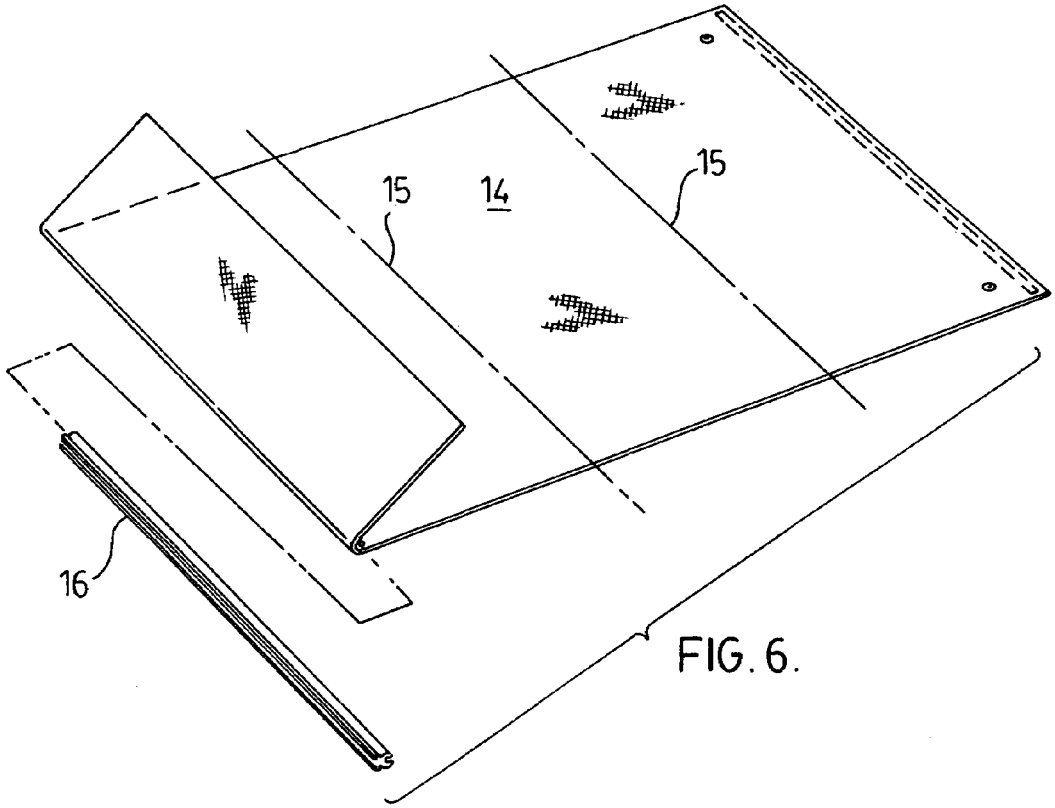
FIG. 6.

CASCADE SHADE

FIELD OF THE INVENTION

This invention relates to the art of window coverings in the form of blinds or shades.

BACKGROUND OF THE INVENTION

Window coverings in the form of "horizontal blinds" account for a substantial part of the window covering market. These blinds which are among the most practical and the least expensive of window coverings allow for proper light control by use of louvers mounted on ladders spanning between a head rail and a bottom rail so that they can be tilted between open and shut positions by a suitable control, usually by cords or a wand, or the entire blind can be raised by a cord control to bring the bottom rail up to the top rail.

Ascetically, however, there is an increasing trend where more and more customers want the appearance of a "soft" window covering such as the type of shade known as a "Roman Shade". This type of shade normally consists of a material (usually fabric vinyl or any other soft type window covering material),a head rail, a bottom rail and a cord control system for raising and lowering the shade. When the shade is raised it creates cascading loops of overlapping folds of material giving a beautiful elegant appearance. However, when the shade is lowered it simply displays a flat piece of material hanging in front of the window. Such a Roman Shade or Blind is shown in U.S. Pat. No. 5,273,096, issued December 285h, 1993. To counteract this bland lowered appearance, this type of shade needs dressing up with a valance or other decorative topper treatment.

More complicated Roman Shades have been disclosed using a system of spacer cords combined with special ribs and cord carriers to achieve the soft look when the shade is lowered as shown in U.S. Pat. No. 5,566,735, issued Oct. 22, 1996.

A major problem with these prior art "Roman Shades" is that the consumer needs to make a choice between opaque, semi-opaque or translucent materials along with the choice of the desired patterns and/or colors when ordering the shade. If, for example, a translucent material is used such as a voile or sheer, then one would not, for example, install this style of "Roman Shade" in a window where privacy is required such as, for example, a bedroom window or a bathroom window. On the other hand, if an opaque material is selected for the shade, then, when the shade is in the lowered position, there is no sunlight entering the room, thus limiting the number of rooms in which this type of "Roman Shade" can be used.

Another problem with "Roman Shades" is that their manufacture and assembly involves a large number of small components requiring assembly, sewing or gluing in preparing both the fabric and the head rail. As a result, the manufacturing process is a very labor intensive and time consuming one making the manufacture of such a product very inefficient and, in turn, making the product a very expensive one.

The present invention is directed to providing a unique Roman Type Shade, hereinafter generally referred to as a cascade shade, which in its preferred form will present the desired beautified soft elegance presented by a series of cascading loops or overlapping folds of material in all positions of the shade from raised to lowered. Further, the invention is directed to such a shade where the consumer can select any desired light transmitting material based on design and color regardless of where the shade is to be used.

A further aspect of the present invention is to enable such a cascade shade to be created in a very simple manner without requiring any specialized equipment, sewing, or gluing operation with the result that no skilled labour to assemble the shade is required and the need for large inventories of various components, fabrics etc. is eliminated.

SUMMARY OF THE INVENTION

The invention resides in creating a cover assembly of sheet material provided with means whereby it can be readily mounted on a conventional horizontal blind to convert the blind into a cascade shade without interfering with the opening and closing and raising and lowering of the blind. In its preferred form, the cover assembly provides the desired cascading loops or overlapping folds of material not only when the blind is raised but for all positions of the blind from raised to fully lowered.

The invention also resides in providing cascade shades so produced.

More particularly, the cover assembly comprises a sheet of any suitable cover material having a width corresponding to the width of the horizontal blind to which it is to be attached and in its preferred form a length substantially greater than the length of the horizontal blind when fully lowered. The sheet has transverse bights thereof trapped in rigid cross members at spaced intervals down the length of the sheet with the transverse members provided with means to attach the cover assembly of the horizontal blind without interfering with the movement of the blind louvers or the raising or lowering of the blind. The cover assembly is also provided with means to attach its upper edge to the blind head rail and its lower edge to the blind bottom rail. Such means, according to the invention, may be a two sided adhesive tape or loop and hook strip fasteners such as sold under the well known trade-mark VELCRO attached to the blind head and bottom rails and to the top and bottom edges of the cover assembly.

According to a preferred form of the invention, the cross members in which the bights of the fabric sheet are held comprises a sleeve having a part cylindrical elongated chamber having a slot or opening at one side and to which fabric material is tucked and then held in place by an inner cylindrical tube or rod inserted into the sleeve to trap the fabric within the sleeve.

Again, according to a preferred form of the invention, the sleeve is provided with an elongated exterior guideway diametrically opposite to the entrance slot and the means for attaching the fabric assembly to the horizontal window includes hooks slideably retained in the sleeve's exterior guideway, the hooks being adapted to hook on to the horizontal blind ladders.

These and other features of the invention will become apparent from the following detailed description taken in conjunction with the accompanying drawings.

BRIEF DESCRIPTION OF THE DRAWINGS

FIG. 1 is a perspective view of a cascade shade embodying the preferred form of the invention showing the shade in the lowered position;

FIG. 5 is a perspective view of a sheet of material selected for the cover assembly being marked at spaced intervals where it is to be secured to the rigid cross members in forming the cover assembly.

FIG. 6 is a perspective view diagramatically illustrating the application of one of the cross members to receive a bight of the sheet material to secure the sheet to the cross member;

FIG. 10, located adjacent FIG. 1, is a plan view of one of the hook members employed by the cover assembly and illustrated how it is hooked on to the blind ladder;

Figure 2:
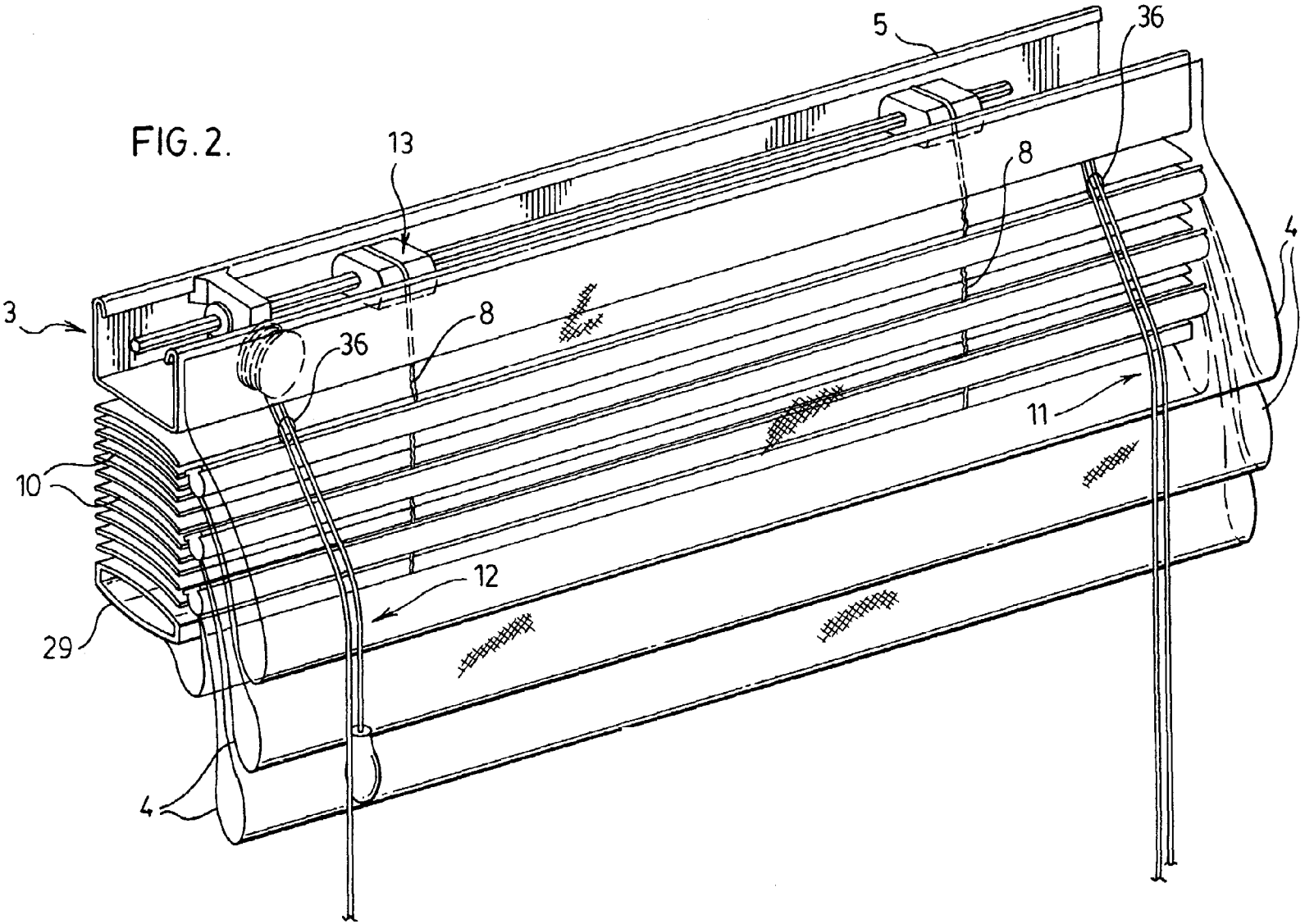
FIG. 2 is a perspective view of the cascade shade of FIG. 1 showing the shade in the raised position.

DETAILED DESCRIPTION ACCORDING TO THE PREFERRED EMBODIMENTS OF THE PRESENT INVENTION

With reference to FIG. 1, there is shown a cascade shade generally designated at 1 comprising a cover assembly 2 attached to a conventional horizontal blind 3 to provide the blind 3 with a cascading series of overlapping loops or folds of material 4 covering the rear or inner face of the blind which would be exposed to the interior of a room or hallway.

The horizontal blind 3 is provided with the usual head rail 5, bottom rail 6 and ladders generally designated at 7 which extend between the head rail and the bottom rail. These ladders 7 comprise two spaced cords 8 having in effect ladder rungs in the form of cords or threads 9 extending therebetween which support louvers 10.

The blind 2 is provided with suitable controls comprising the usual cord control 11 for raising and lowering the blind and, in the blind illustrated, a cord control 12 for tilting the louvers 10. These cord controls operate through the conventional rotating and rocking mechanism generally designated at 13 to which the upper ends of the ladder cords 8 are connected.

The cover assembly 1 is assembled using a sheet 14 of the desired material selected to give the desired ascetic appearance. While it will be understood that any covering material which can be gathered into folds or loops may be used, the preferred material is a soft fabric which may be a sheer material or may display a desired pattern with the material normally selected to permit at least some light transmission therethrough to take full advantage of the features of the horizontal blind to which it is attached.

This sheet 1 will have a width corresponding to the width of the horizontal blind 2 and, preferably, a length substantially greater than the distance between the head rail and the bottom rail 6 of the blind when the blind is lowered as illustrated in FIG. 1.

Sheet 14 is first measured with its surface to be displayed down and marked as indicated by the transverse lines 15 in predetermined spaced relation which is to govern the size of the ultimate cascading loops or folds 4 of the assembly. Then, as diagrammatically illustrated in FIG. 6, the sheet is attached along the transverse lines 15 to a rigid cross bar or member generally designated at 16. While FIG. 6 shows only one section of the sheet about to be secured to a cross member 16, it will be understood that this will be repeated at the various other markings 15.

Figure 7:
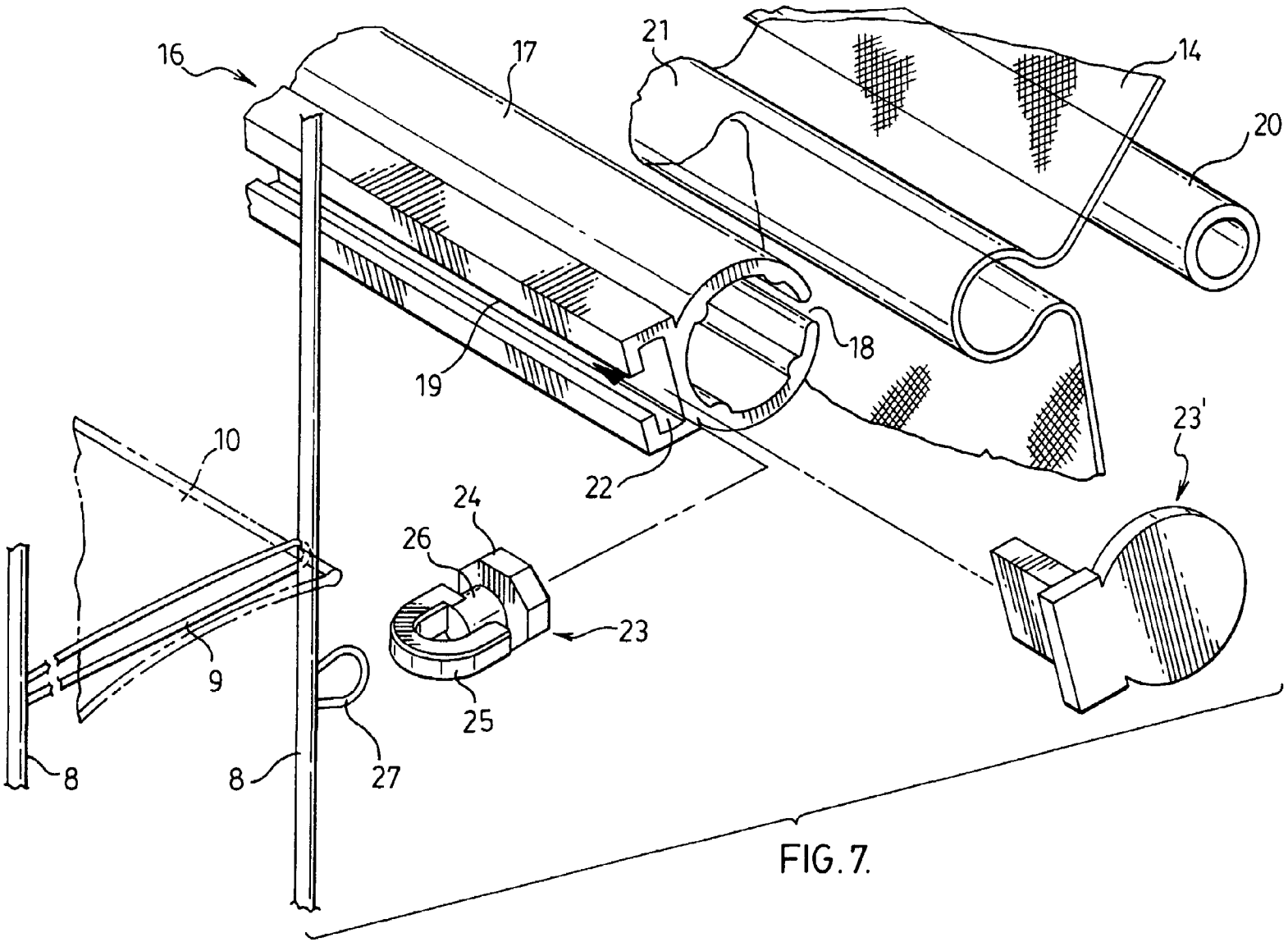
FIG. 7 is a broken away exploded perspective view illustrating a loop or bight of the sheet material about to be inserted into the sleeve portion of the outer or main cross member with a material trapping rod ready to be inserted into the sleeve portion, and further showing a hook member ready for assembly with the undercut guideway portion of the outer cross member ready for hooking on to the ladder of a horizontal blind.
Figure 8:
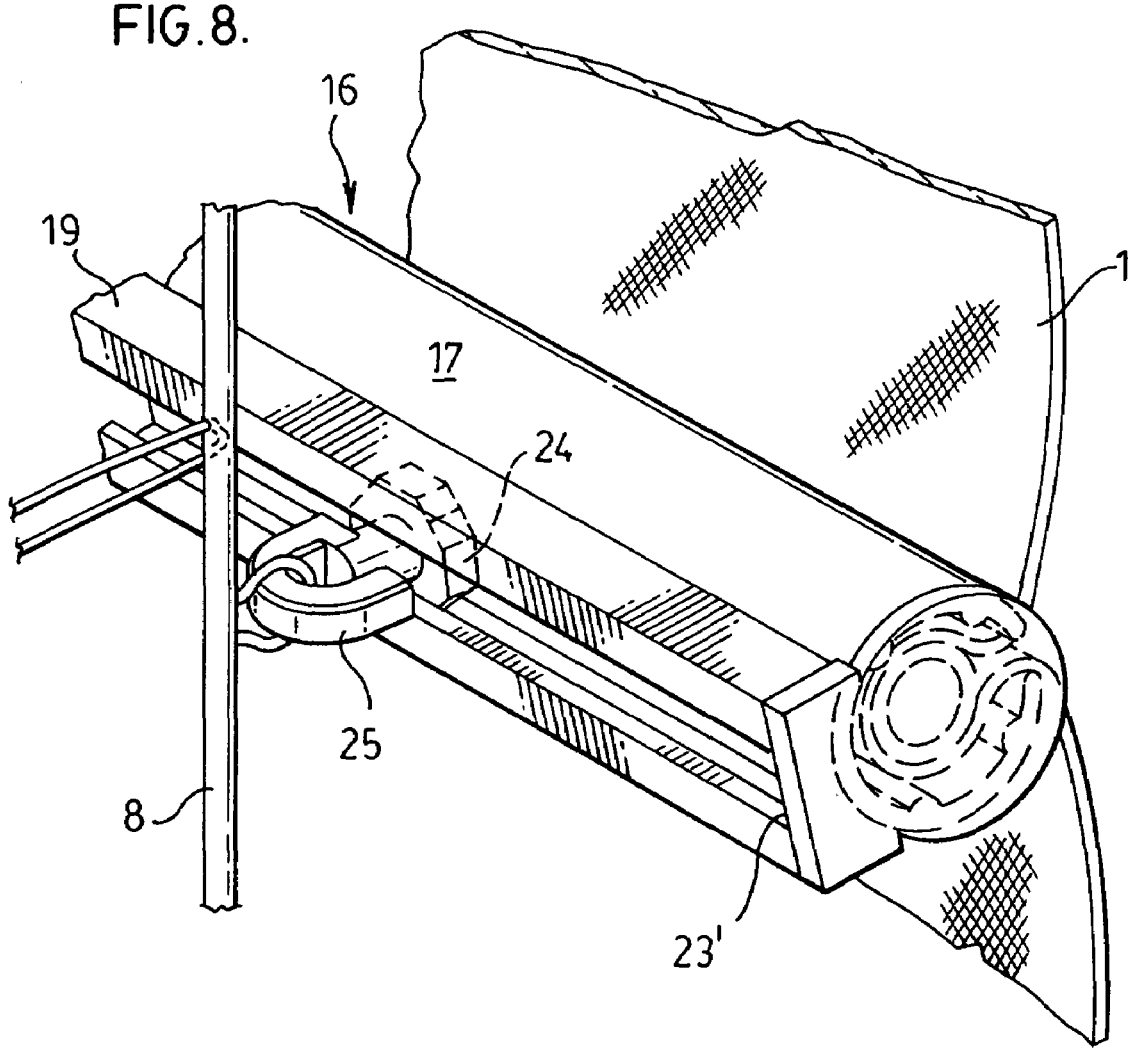
FIG. 8 is a broken away perspective view illustrating the completion of the assembly of the parts shown in FIG. 7 showing the inner rod trapping the sheet material in the sleeve portion of the cross member and showing the hook member mounted on the undercut guideway and hooked to the ladder of a horizontal blind.
Figure 9:
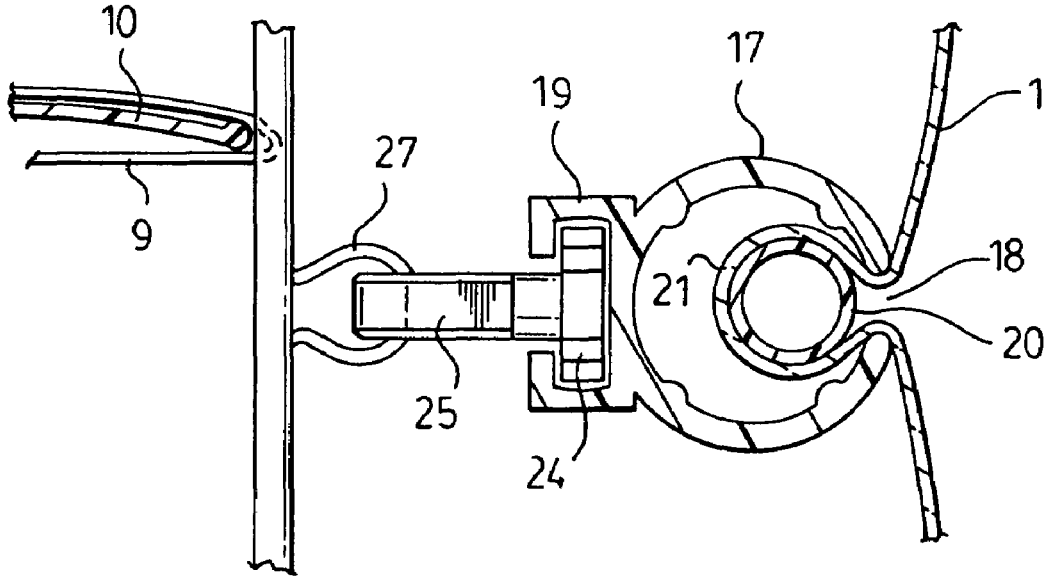
FIG. 9 is a broken away enlarged vertical section showing the attachment of the cover assembly to the horizontal blind ladder.

With reference to FIGS. 7, 8 and 9, it will be seen that the cross bar or member 16 has a generally tubular section 17 having a longitudinal slot 18 at one side while at the opposite side it has an undercut guideway 19.

As illustrated in FIG. 7, a loop or bight of the sheet material along one of the marked lines 15 is about to be inserted through the slot 18 into the tubular section 17 of the cross member 16 where it is to be trapped within the tubular section 17 by a small tube or rod 20. Preferably the tubular section 17 is provided with sufficient resiliency to allow the tube 20 to be inserted into the tubular section through the slot 18 to trap a bight 21 of the sheet material within the tubular section 17 as illustrated in FIGS. 8 and 9.

As illustrated in FIG. 7, the guideway 19 has an undercut slot 22 to slideably and interlockably receive one of the connectors 23 for connecting the cross bar or member 16 to one of the cords 8 or a ladder 7 of the blind. The ends of the cross member are closed by end covers 23', one such cover being shown in FIG. 7.

As will be seen, each connector 23 has a base 24 which fits within the slot 22 of the guideway 19. This base carries a locking ring 25 mounted on a reduced neck portion 26 which extends outwardly through the guideway slot 18. The locking ring 25 is in the form of a hook open at one side to receive one of the attachment loops 27 provided on the ladder cord 8 as shown in FIGS. 8 and 9 and particularly FIG. 10.

It will be understood that in the preferred embodiment of the invention illustrated the spacing between where the cross members 16 are attached to the cords 8 of the ladders 17 will be less than the spacing between the cross members at the time of the attachment of the sheet thereto, i.e. the space is between the lines 15, so that their attachment to the ladders will create the cascading loops or folds 4 illustrated in FIGS. 1 and 2.

To complete the mounting of the cover assembly 2 to the blind, the top edge portion 28 of sheet 14 is secured to the blind head rail 5 and the bottom edge portion 29 is secured to the bottom rail 6.

Figure 11:
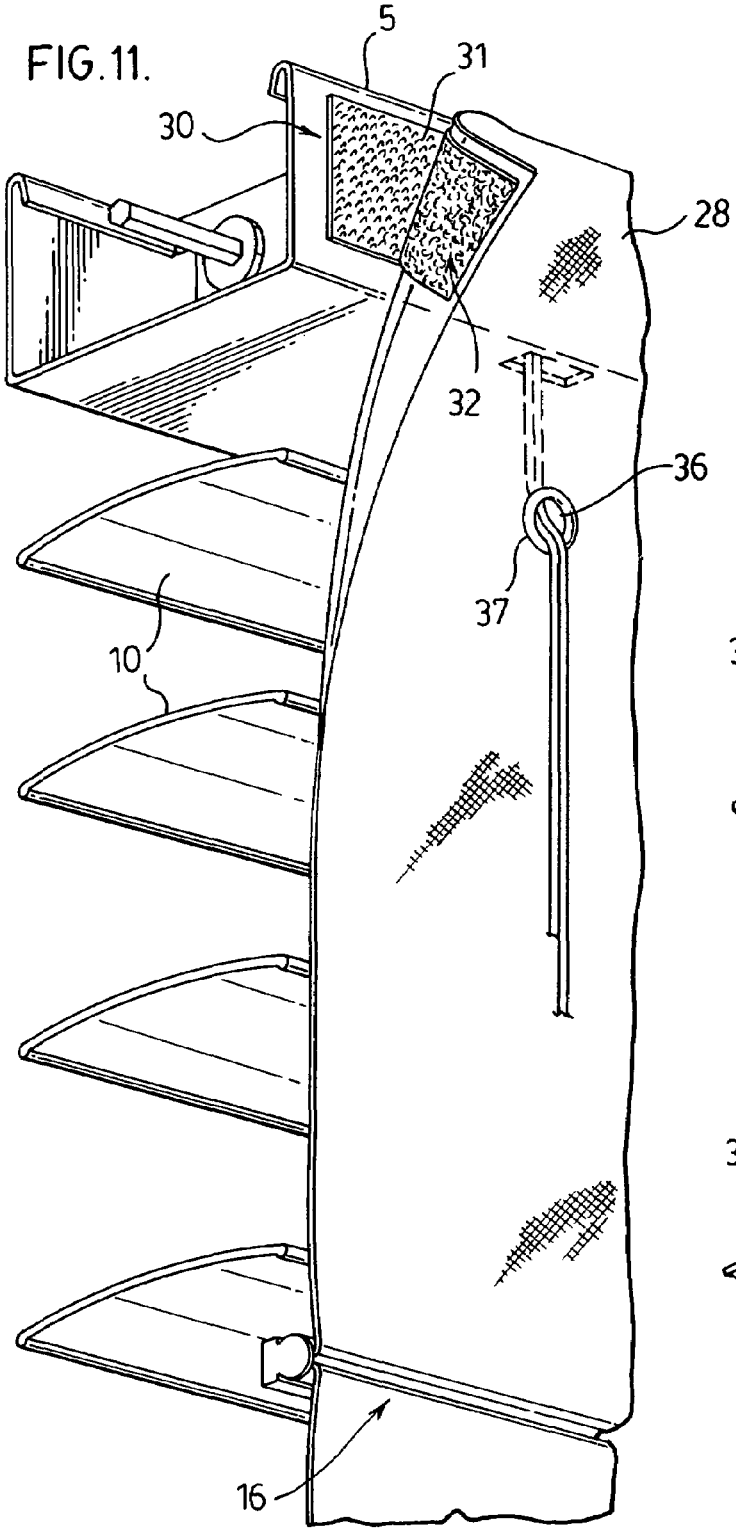
FIG. 11 is a broken away perspective view illustrating the use of loop and hook strips to attach the upper edge of the material of the cover assembly to the head rail of the horizontal blind.

In this connection, as illustrated in FIG. 11, a preferred way of securing these edge portions to the rails is by means of loop and hook strips. These strips have adhesive on one side and their loops and hooks on the other side. As illustrated in FIG. 11, one of the loop and hook strips 30 is adhered to the head rail 5 with its interlocking network surface 31 facing outwardly. A similarly mounted loop and hook strip 32 is adhered to the top edge portion 28 of the sheet 14 to provide a releasable connection between the head rail and the sheet.

It will be understood that the connection between the bottom edge portion 29 of the sheet and the bottom rail will be effected in the same manner.

Figure 12:
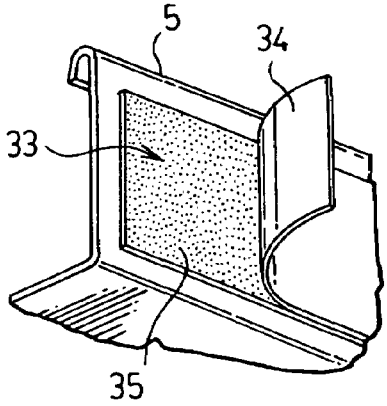
FIG. 12 is a broken away perspective view showing the application of the double sided adhesive tape to the horizontal blind head rail with the release layer being removed from the outer adhesive surface.
Figure 13:
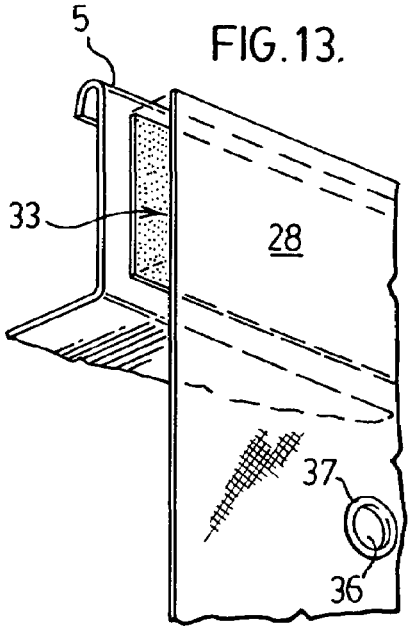
FIG. 13 is a broken away perspective view illustrating the securement of the sheet material of the cover assembly to the blind head rail by means of the adhesive tape.

Alternatively, the edge portions of the sheet may be secured to the blind rails by a two sided adhesive tape 33 shown in FIG. 12 as having been adhered to the head rail 5 with the release paper 34 being pulled back to expose the adhesive surface 35 ready to be adhered to the top edge portion 28 of the sheet 14 as illustrated in FIG. 13.

Figure 14:
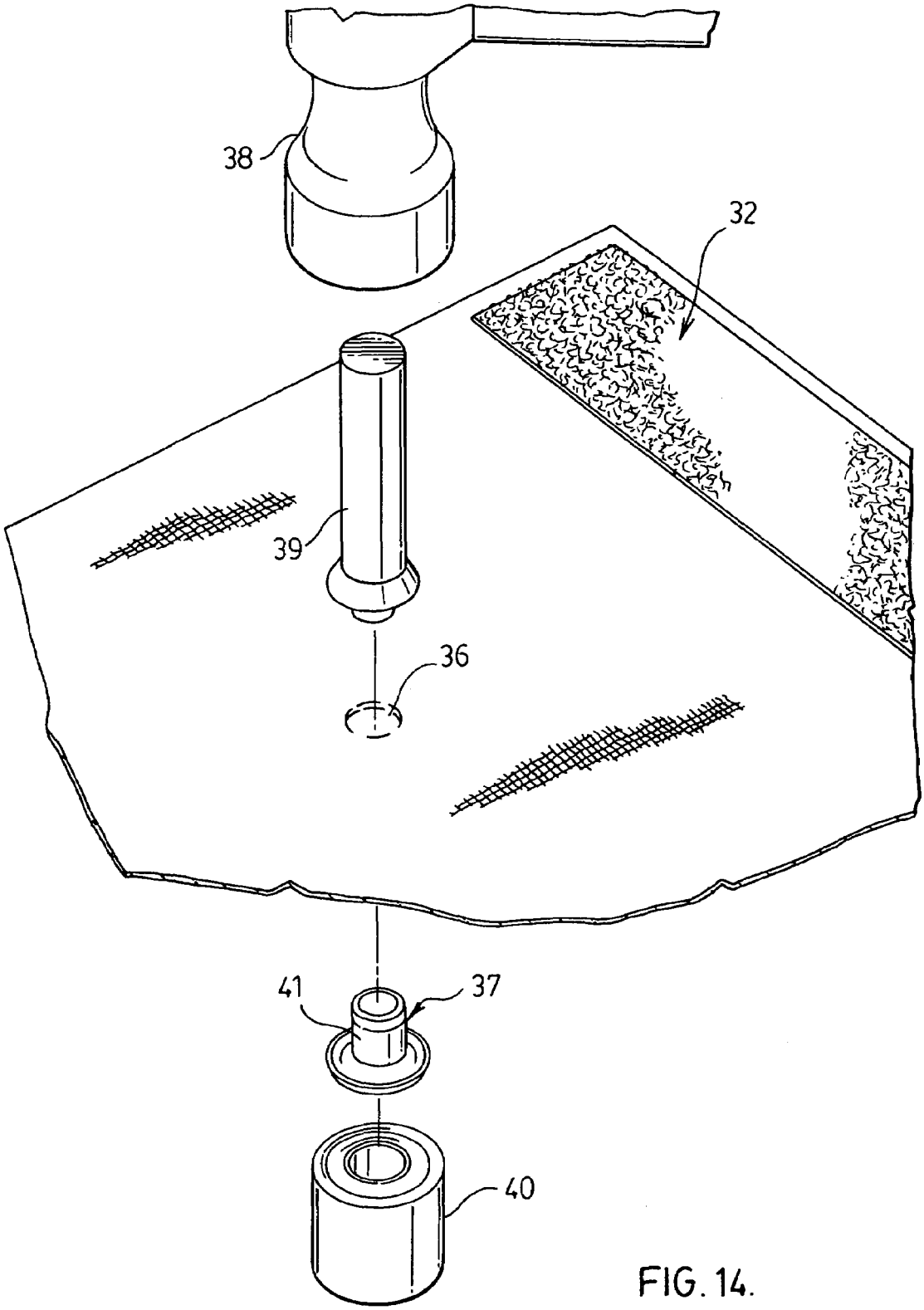
FIG. 14 is a broken away perspective view illustrating the application of a groumet to the sheet of the cover assembly to strengthen the hole provided in the sheet for the passage of one of the operating cords of the horizontal blind as shown in FIG. 11.

To enable the cord controls 11 and 12 to be operated exteriorly of the sheet 14, the sheet is cut to provide holes 36 through which these control cords 11 and 12 can be threaded. To provide for smooth running of the cords through these holes, they may be reinforced with groumets such as are available in any fabric store. FIG. 14 illustrates a groumet 37 about to be assembled through a hole 36 in sheet 14 using a hammer 38, spreading tool 39 and anvil 40.

Once the reduced portion 41 of the groumet has been threaded the hole 36 and seated on the anvil 40, the tool 39 under the blow of the hammer will spread the end of the mount portion 41 to overlie the sheet to provide the completed groumet protection illustrated by the groumets in FIGS. 7 and 13.

Once the cover assembly has been mounted on the horizontal blind, it will be seen that with the blind lowered as shown in FIG. 1, the cascading loops or folds 4 of the sheet material are presented flowing down the length of the lowered blind.

Figure 3:
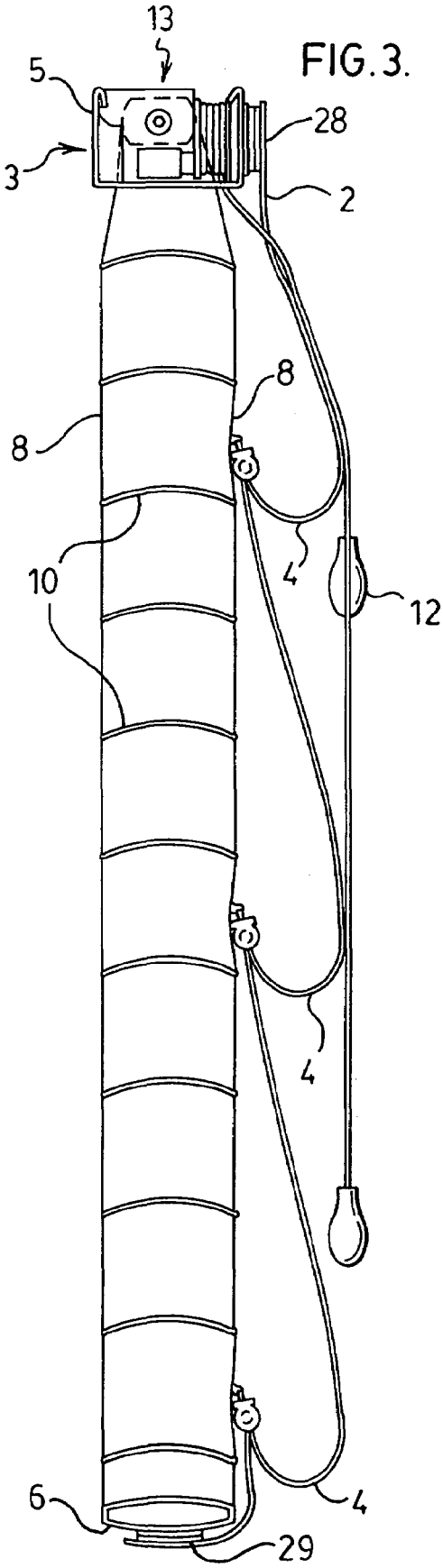
FIG. 3 is an end elevational view of the shade of FIG. 1 showing the louvers in the full open position.
Figure 4:
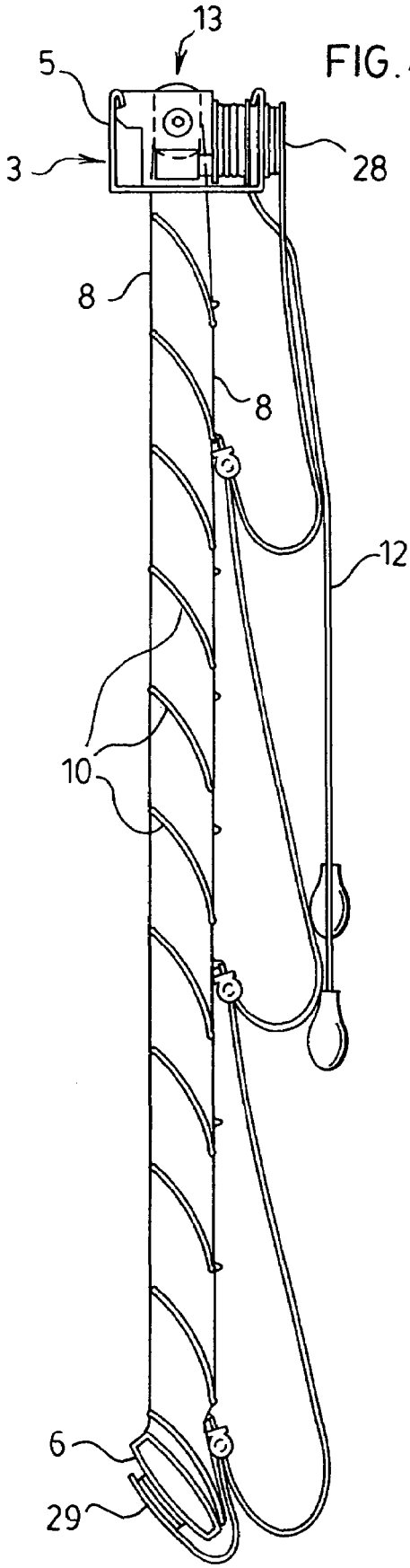
FIG. 4 is a view similar to FIG. 3 but showing the louvers in the closed position.

As illustrated in FIG. 2, these loops 4 are more pronounced when the blind is raised. As shown in FIGS. 3 and 4, the louvers can be operated between the open position of FIG. 3 and the closed position of FIG. 4 without affecting the presentation of the overlapping or cascading loops or folds of the sheet material. Conversely, the provision of the cascading folds 4 of the sheet material do not in any way interfere with the opening and closing of the horizontal blind as shown in FIGS. 3 and 4 or the raising and lowering of the blind as shown in FIGS. 2 and 1.

While it is normally desired to provide sheet 1 with at least a degree of light transmitting properties to take advantage of all of the horizontal blind functions, there may be circumstances where a customer might desire an opaque fabric sheet because of its particular decor or pattern. In this case, the light transmitting function of the blind through the opening and closing of the louvers 10 would not be available.

Again, while preferably the length of the sheet material 4 is greater than the distance between the head and bottom rails of the blind when it is fully lowered the length of the sheet could be made equal to this distance in which case the cascade loops or folds would only occur where the blind was raised.

In all cases, however, the attachment of the cover assembly to the low cost horizontal blind takes advantage of a function or functions of the blind without interfering with either the raising or lowering of the blind or the opening or closing of the blind louvers.

It will be understood that other variations in details in the fabric cover assembly may be made without departing from the scope of the appended claims.

The invention claimed is:

1. A cascade shade comprising the combination of a horizontal blind having a head rail, a bottom rail, a plurality of louvers mounted on ladders extending between said head rail and said bottom rail, and controls for raising and lowering the blind, and for operating the louvers between open and closed positions, and a cover assembly attached to said blind, said cover assembly comprising a sheet of material having a width to extend across the blind and a length at least equal to the spacing between said bead rail and said bottom rail with the blind fully lowered, said sheet having an upper edge and a lower edge, means attaching said upper sheet edge to said of material blind head rail and said lower sheet edge to said blind bottom rail, a plurality of rigid parallel sheet retaining members extending across the width of said sheet of material transversely of its length and gripping transverse bights of said sheet material to divide said sheet of material into horizontal panels, and means for securing said sheet retaining members of material to said blind without interfering with the operation of said blind by said controls whereby said sheet of material with said horizontal panels covers said blind when said blind is lowered and provides overlapping loops or folds of sheet material, at least when said blind is raised.

2. A cascade shade as claimed in claim 1 in which said sheet of material is a light transmitting material.

3. A cascade shade as claimed in claim 1 in which said sheet of material has a length greater than the distance between said top and bottom rails of said blind when said blind is fully lowered whereby said sheet of material with said horizontal panels provides overlapping loops or folds of said sheet of material with said blind lowered as well as when said blind is raised.

4. A cascade shade as claimed in claim 1 in which said means for securing said cover assembly to said blind are releasable.

5. A cascade shade as claimed in claim 4 in which said releasable means comprise hook and loop strips securing the upper edge of said sheet to said blind head rail and the lower edge of said sheet to said blind bottom rail, and hook members securing said sheet retaining members to said blind ladders.

6. A cascade shade as claimed in claim 1 in which said sheet retaining members each comprises an outer sleeve having a longitudinal slot therein into which a bight of sheet material is tucked and a rod inserted into said outer sleeve trapping said sheet bight within said sleeve.

7. A cascade shade as claimed in claim 6 in which said outer sleeve of each of said cross members has on its outer side opposite to said slot an undercut guideway extending throughout its length, and said means for attaching said sheet retaining members to said blind comprise connectors slidingly and interlockably received in said guideway.

8. A cascade shade as claimed in claim 7 in which said connectors each comprise a ring clip having a base slideable in said guideway, said ring clip being clipped on to a ladder of said blind.

9. A cascade shade as claimed in claim 8 further having end caps closing the ends of said outer sleeve, said end caps having webs projecting therefrom inserted into said undercut guideway.

10. A cover assembly for attachment to a horizontal blind having a head rail and a bottom rail, ladders extending between said head and bottom rails supporting louvers thereon and means for raising and lowering the blind and operating the louvers to close and open the blind, said cover assembly comprising a sheet of material having a width to extend across the width of the blind and a length at least equal to the length of the lowered blind, a plurality of spaced rigid parallel members extending across the width of said sheet of material transversely of its length and to which said sheet is secured to divide said sheet into horizontal panels, means for securing said rigid parallel members to the blind and means to secure the upper and lower edges of said sheet of material to the head and bottom rails of the blind respectively.

11. A cover assembly as claimed in claim 10 in which said sheet of material is a light transmitting material.

12. A cover assembly as claimed in claim 10 in which said sheet of material has a length greater than the distance between said head and bottom rails of said blind with said blind fully lowered.

13. A cover assembly as claimed in claim 10 in which said means for securing the edges of said sheet to the blind head and bottom rails are releasable.

14. A cover assembly as claimed in claim 13 in which the upper and lower edges of said sheet material have a hook and loop strip attached thereto for mating with a hook and loop strip on the head and bottom rails of the blind.

15. A cover assembly as claimed in claim 10 in which said means for securing said rigid parallel members to the blind are releasable.

16. A cover assembly as claimed in claim 15 in which each said rigid members comprises art outer sleeve having a longitudinal slot therein into which a bight of sheet material is tucked and a rod inserted into said outer sleeve traps said bight of sheet material within said sleeve, said outer sleeve having on its outer side opposite to said slot an undercut guideway extending throughout its length, and said means for securing said rigid members to said blind comprise connecters slideably and interlockably received in said guideway.

17. A cover assembly as claimed in claim 16 in which said connectors each comprise a ring clip for clipping on to a ladder of the blind, said clip having a base slideably received in said guideway.

* * * * *